United States Patent [19]

Nelson

[11] 4,372,330

[45] Feb. 8, 1983

[54] METHOD AND APPARATUS FOR ATTACHMENT OF HAIR UNITS

[75] Inventor: Charles W. Nelson, Mission, Kans.

[73] Assignee: Apollo Hair Systems, Inc., Mission, Kans.

[21] Appl. No.: 310,732

[22] Filed: Oct. 13, 1981

[51] Int. Cl.[3] ..... A41G 3/00

[52] U.S. Cl. ..... 132/53; 132/5

[58] Field of Search ..... 132/5, 9, 53, 54; 3/1

[56] References Cited

U.S. PATENT DOCUMENTS

| | | | |
|---|---|---|---|
| 1,042,972 | 10/1912 | Ronshkowsky | 132/53 |
| 3,871,389 | 3/1975 | Bauer | 132/53 |
| 3,970,092 | 7/1976 | Nelson | 132/53 |
| 4,296,765 | 10/1981 | Bachtell | 132/53 |

*Primary Examiner*—G. E. McNeill

*Attorney, Agent, or Firm*—Schmidt, Johnson, Hovey & Williams

[57] ABSTRACT

An improved method for attaching a hair unit to the user's head is disclosed wherein the user's natural hair is employed to attach the hair unit in place. In practice, a pair of filaments, dispensed from a unique apparatus, are intertwined with tufts of the user's natural hair into a braid by a unique and simple method. An appropriate hair unit can be secured to the finished braid by any one of a number of techniques. The filament dispensing apparatus disclosed herein includes a frame suitable for mounting on a wall, and a pair of adjustable control assemblies for controlling the rate at which filament is dispensed.

2 Claims, 14 Drawing Figures

Fig. 11.
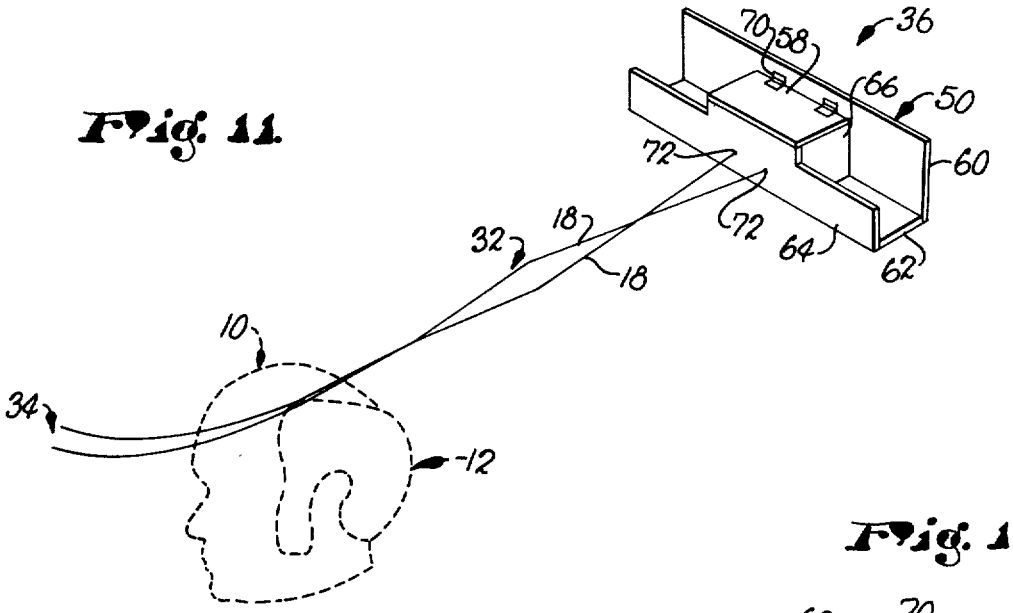
Fig. 12.
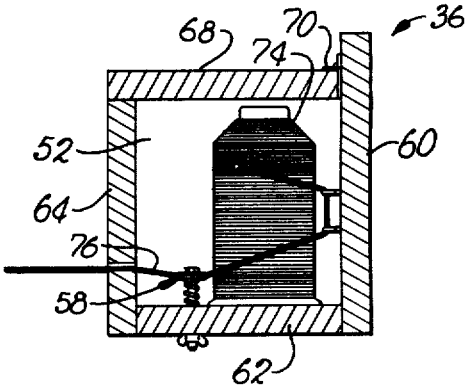
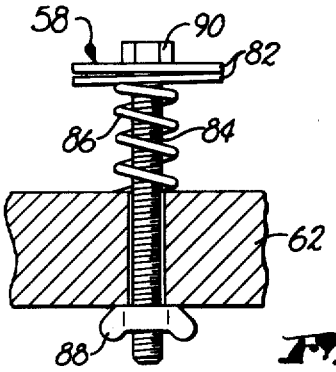
Fig. 13.
Fig. 14.
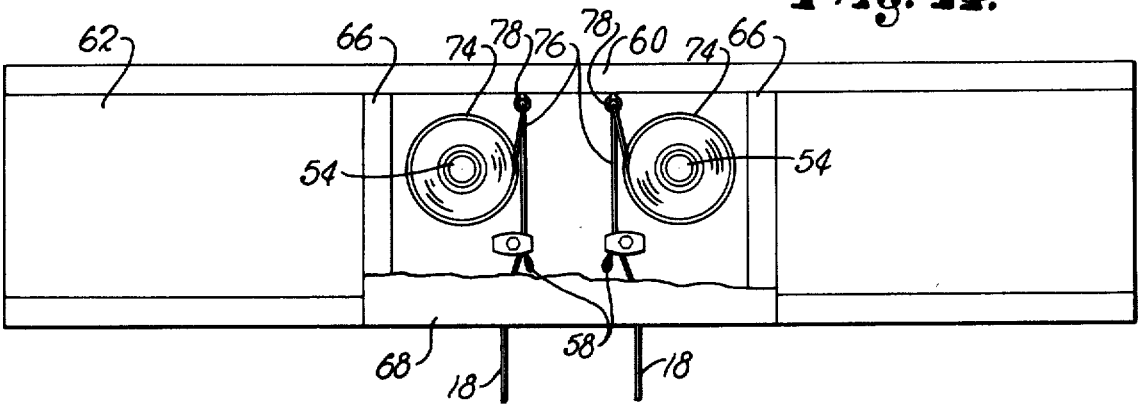

METHOD AND APPARATUS FOR ATTACHMENT OF HAIR UNITS

BACKGROUND OF THE INVENTION

1. Field of the Invention

The present invention is concerned with a method for attaching hair units applicable to situations wherein the user of the hair unit retains at least some natural hair, and with a unique filament dispensing apparatus used in conjunction with the disclosed method. More particularly, it is concerned with a method wherein tufts of the user's hair are intertwined with filament to provide a securing base to which a hair unit may be attached. The filament dispensing apparatus is designed to dispense two juxtaposed stretches of filament, and to control the rate at which filament is dispensed.

2. Description of the Prior Art

It is known in the art to employ a hair unit user's natural hair in forming a securing base to which a hair unit can be attached. Heretofore, however, methods for forming the securing base have generally required that some special mechanical contrivance be attached to the user's natural hair, or have required intricate weaving techniques that are time consuming and can successfully be accomplished only be experienced operators. A simple method for attaching a hair unit to a user's natural hair is needed that eliminates the need for attaching mechanical contrivances next to the user's head, and that can be rapidly and easily performed.

SUMMARY OF THE INVENTION

The problems outlined above are in large measure solved by the method and apparatus for attachment of hair units in accordance with the present invention. That is to say, the method hereof does not require mechanical contrivances be secured to the user's natural hair, and is easily and quickly performed by even minimally experienced operators.

The method of the present invention broadly includes the steps of providing two juxtaposed stretches of filament, forming a plurality of tufts from strands of the recipient's natural hair, braiding the filament stretches and intertwining the tufts of hair with the stretches.

The preferred method of attaching the hair unit to the user's head comprises the steps of forming a first tuft of the user's natural hair, anchoring the filament around the base of the tuft so as to form first and second filament pairs from the filament stretches, twisting one pair of filaments to form a plurality of windings, forming successive tufts from the user's natural hair, and intertwining the successive tufts and the second filament pair within the windings of the first filament pair.

The dispenser apparatus designed for use with the method of the present invention broadly includes a frame having a spindle-receiving cavity, a pair of elongated spindles disposed within the cavity and respectively configured for supporting spools of filament, and a dispensing control unit for controlling the rate at which filament is dispensed.

In particularly preferred forms, the dispensing control unit includes a filament-engaging assembly associated with each spindle, each assembly including a pair of washers spring biased together for receiving a filament therebetween; the washers being mounted on a bolt and wing nut assembly.

BRIEF DESCRIPTION OF THE DRAWINGS

FIG. 11 is a perspective view of a filament dispensing apparatus in accordance with the present invention, phantom lines depicting the head of a partially bald man, and two filament stretches extending from the dispenser to the man's head;

FIG. 12 is a sectional view of a filament dispenser, with one spool of filament shown mounted therein;

FIG. 13 is a fragmentary, partially sectional view of a filament dispenser depicting the dispenser control apparatus;

FIG. 14 is a fragmentary view of a filament dispenser in accordance with the present invention.

DESCRIPTION OF THE PREFERRED EMBODIMENT

Figure 1:
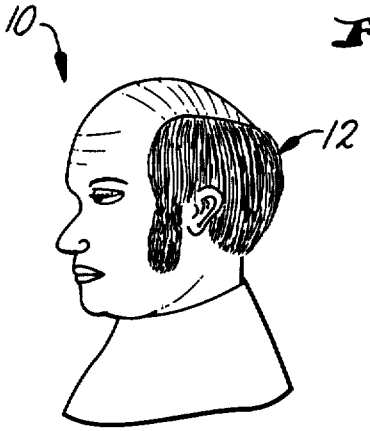
FIG. 1 is a perspective view of a partially bald man, prior to the attachment of a hair unit.
Figure 2:
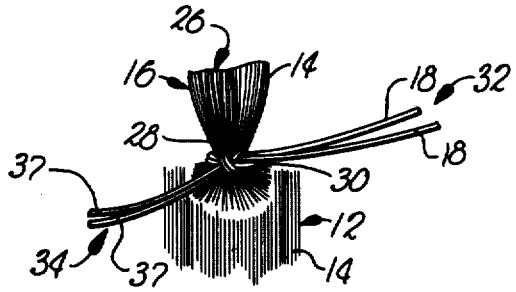
FIG. 2 is a perspective view of a tuft of hair with two filament stretches anchored to the base of the tuft, the filament stretches presenting two opposite extending filament pairs.
Figure 3:
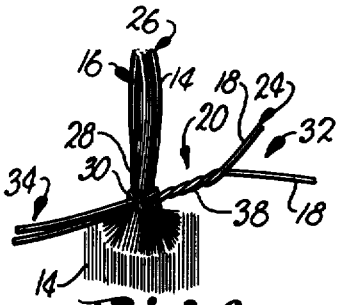
FIG. 3 is similar to FIG. 2 but with one filament pair twisted.

Turning to the drawings, FIG. 1 illustrates a man 10 who is partially bald but who has retained at least some natural hair 12, principally about the side of the head. The present invention is primarily concerned with a method and apparatus for attachment of hair units to such an individual.

The method for attachment of a hair unit in accordance with the present invention broadly includes the steps of gathering several strands 14 of hair 12 into a plurality of tufts 16, providing a pair of juxtaposed filament stretches 18, twisting the filament stretches 18 about each other to form a plurality of windings 20, and passing the tufts 16 between the windings 20.

In particularly preferred forms, the filament stretches 18 are intertwined into a braid 24. To form the braid 24, several strands 14 of hair 12 are gathered into a first tuft 26, and a pair of cable stretches 18 are anchored to the base 28 of the tuft 26 by any suitable means such as by tying a knot 30. A drop of non-allergenic glue 31 may be dispensed from container 33 onto the knot 30. The filament stretches 18 are tied to the base 28 of the tuft 26 at a point intermediate the end of the stretches 18 so as to form first and second filament pairs 32, 24. The ends of first filament pair 32 opposite the ends thereof anchored to the tuft 26 are received within a filament dispenser 36 as best seen in FIG. 11. The ends of second filament pair 34 opposite the ends thereof anchored to the tuft 26 are free and unattached, and the filament pair 34 may be of sufficient length to be intertwined throughout the full length of the braid 24, but such is not required and only tag ends 37 need be provided if desired.

Figure 4:
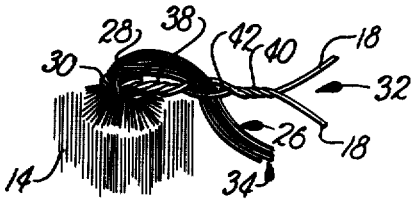
FIG. 4 is similar to FIG. 3 but depicts the second filament pair and leading end of the tuft of hair received by an eye in the winding of the twisted filament pair.
Figure 5:
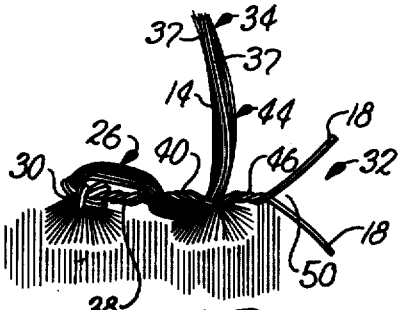
FIG. 5 depicts a second tuft of hair and the second filament pair received through a second eye in the windings of the first filament pair.
Figure 6:
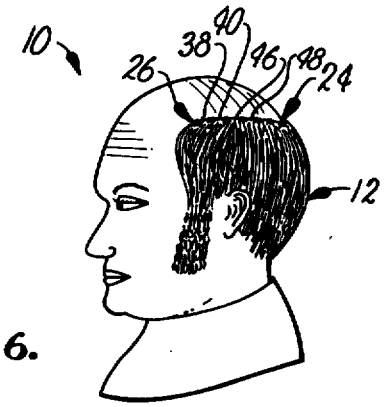
FIG. 6 is a perspective view of a bald man with successive tufts of hair intertwined with a braid of filament, the braid readied for the attachment of a hair unit thereto.
Figure 7:
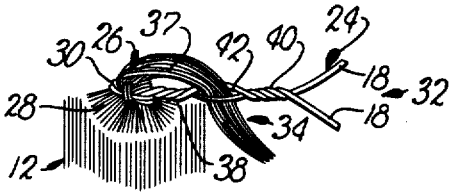
FIG. 7 is similar to FIG. 4, but depicts the second filament pair cut short and the tag ends received within an eye in the winding of the first filament pair.
Figure 8:
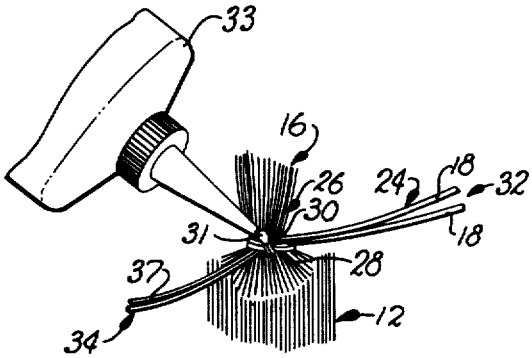
FIG. 8 depicts a drop of glue being placed on the filament stretches.
Figure 9:
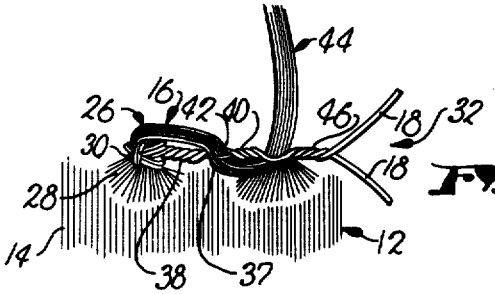
FIG. 9 is similar to FIG. 7 but depicts a second tuft received through a second eye in the windings of the first filament pairs; the second filament pair cut short.

When the filament stretches 18 are anchored in place to the base 28 of the first tuft 26, the members of the first filament pair 32 can be twisted about each other. As best seen in FIGS. 4 and 7, the twisting of first filament pair 32 forms respective opposite-handed windings 38, 40. The portion of the first filament pair 32 between the windings 38, 40 defines an eye 42. The free ends of the tuft 26 and the second filament pair 34 are passed through the eye 42. With the tuft 26 and second filament pair 34 in place in the eye 42, the respective windings 38, 40 are shifted together, restricting the eye 42 and capturing the tuft 26 and the second filament pair 34 within the eye 42.

A second tuft 44 of natural hair 12 is next formed, advantageously spaced apart from the first tuft 26 a distance of about one quarter inch. The second tuft 44 is passed between the filament members of the first filament pair 32, and the tag ends 37 of the second filament pair 34, if of sufficient length, may also be passed between the filament members of the first filament pair 32. The members of the first filament pair 32 are then opposite-handed windings 46, 48. The second twisting of first filament pair 32 effectively locks the second tuft 44 and, if desired, the second filament pair 34, between the windings 40, 46 of the first filament pair. The second tuft 44 is then passed through the eye 50 formed by first filament pair 32 between the windings 46, 48.

The process of gathering natural hair 12 into tufts 16, and locking the tufts 16 between the windings of first filament pair 32 is successively repeated as many times as is necessary to form a braid 24 of sufficient length for attaching a hair unit (not shown) to the braid 24. It will be perceived that the second filament pair 34, if of sufficient length, may be successively passed through each eye in the windings of first filament pair 32, and locked therein. When the braid 24 is completed, the first and, if desired, the second filament pairs 32, 34 are anchored to one of the tufts 16 by any suitable means such as by tying a knot (not shown). A drop of non-allergenic glue may be placed on the knot.

Those skilled in the art will appreciate that if the natural hair 12 of the man 10 is of sufficient length, the tufts 16 may be passed through a plurality of eyes. A hair unit (not shown) is advantageously attached to the finished braid 24 by stitching.

Figure 10:
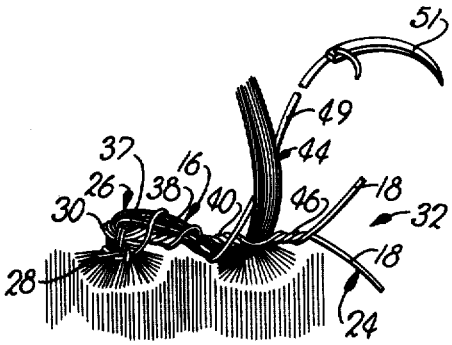
FIG. 10 depicts two filament stretches interwined with tufts of natural hair, with a third wrapping stretch of filament wound about the first two stretches.

Referring to FIG. 10, a third filament stretch 49 may be wrapped around the finished braid 24. A needle 51 is advantageously attached to filament stretch 49 to facilitate wrapping of the braid 24 therewith. Wrapping the braid 24 with third stretch 49 is especially advantageous in instances where it is objectionable to apply glue 31 to the braid 24.

A filament dispenser 36 in accordance with the present invention is preferably configured for mounting on a wall, and broadly includes a frame 50 that has a spindle-receiving cavity 52 therein, a pair of elongated spindles 54 disposed within the cavity 52, and a dispensing control apparatus 56 that includes a pair of spaced apart filament engaging assemblies 58.

The frame 50 includes a rear wall 60, a base 62, a front wall 54, two cavity-defining sidewalls 66 and a shiftable cover 68 secured to the rear wall 60 by a pair of hinges 70. The front wall 64 includes a pair of spaced apart filament-clearing apertures 72. The pair of spindles 54 are connected to the base 62, and are symmetrically disposed within the cavity 52 equidistant from the rear wall 60. A pair of filament spools 74 are supported by the spindles 54. The filament spools 54 are depicted in FIGS. 12 and 14 as being wrapped with a length of filament 76 from which the filament stretches 18 are drawn. Two pair of filament-leading eye hooks 78 are received within the rear wall 60. The filament-engaging assemblies 58 are supported by the base 62 through a pair of apertures 80. The filament 76 is lead from a filament spool 74 through a pair of eye hooks 78 and a filament-engaging assembly 58 before the filament 76 clears the filament dispenser 36 through one of the apertures 72 in the front wall 64.

The filament-engaging assemblies 58 preferably include a pair of filament-engaging washers 82 supported on bolt 84, and spring biased together by spring 86. A hand adjustable wing nut 88 is threadably received by the bolt 84 at the underside of the base 62.

In operation, the filament 76 is received by the filament-engaging assembly 58 between the washers 82. The spring 86 supports the washers 82 away from the upper surface of the base 62, and biases the washers 82 together in an abutting relationship with the head 90 of the bolt 84. The wing nut 88 may be rotated clockwise to compress the spring 86 and thereby increase the pressure biasing the washers 82 together. Likewise the wing nut 88 may be rotated counterclockwise to decrease the biasing pressure exterted by the spring 86. An increase in the pressure biasing the washers 82 together will increase the friction between the washers and the filaments 76, and thereby decrease the rate at which filament 76 may be dispensed. A person using the filament dispenser 36 may therefore adjust the rate at which filament 76 is dispensed from the filament dispenser 36 by adjusting the wing nut 88.

I claim:

1. A method of attaching a hair unit by anchoring a braid to the natural hair of a recipient comprising the steps of:

(a) gathering several strands of hair into a tuft;

(b) providing filament means presenting a pair of juxtaposed filament stretches;

(c) anchoring said filament stretches to said tuft intermediate the ends of said filament stretches so as to form at least one filament pair;

(d) twisting the members of said filament pair about each other so as to form a first winding having a first direction of rotation, a second winding having a direction of rotation opposite to said first winding, the portion of said stretches between said windings defining an eye;

(e) passing the free ends of said strands of said tuft through said eye;

(f) locking said tuft in said eye by shifting said respective windings together for restricting said eye and capturing said tuft;

(g) gathering several strands of hair into a second tuft;

(h) passing said second tuft between said members of said filament pair;

(i) successively repeating steps (d) through (h) inclusively, using respective additional tufts.

2. A method as in claim 1, including the steps of forming a second filament pair and passing said second filament pair between said windings.

* * * * *